US010458072B2

(12) United States Patent
Hoetzendorfer

(10) Patent No.: US 10,458,072 B2
(45) Date of Patent: Oct. 29, 2019

(54) METHOD FOR RENEWAL OF A TRACK

(71) Applicant: PLASSER & THEURER EXPORT VON BAHNBAUMASCHINEN GESELLSCHAFT M.B.H., Vienna (AT)

(72) Inventor: Patrick Hoetzendorfer, Engerwitzdorf (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 206 days.

(21) Appl. No.: 15/319,024

(22) PCT Filed: May 22, 2015

(86) PCT No.: PCT/EP2015/001060

§ 371 (c)(1),
(2) Date: Dec. 15, 2016

(87) PCT Pub. No.: WO2015/197153

PCT Pub. Date: Dec. 30, 2015

(65) Prior Publication Data

US 2017/0121915 A1 May 4, 2017

(30) Foreign Application Priority Data

Jun. 24, 2014 (AT) ..... A 496/2014

(51) Int. Cl.
*E01B 29/02* (2006.01)
*B66C 23/50* (2006.01)

(52) U.S. Cl.
CPC ..... *E01B 29/02* (2013.01); *B66C 23/50* (2013.01)

(58) Field of Classification Search
CPC ..... E01B 27/00; E01B 27/04; E01B 27/06; E01B 29/00; E01B 29/02; E01B 29/04; E01B 29/05; E01B 33/00; E01B 33/02; E01B 33/06
See application file for complete search history.

(56) References Cited

U.S. PATENT DOCUMENTS 4,502,389 A * 3/1985 Theurer ..... E01B 27/02 104/12
5,469,791 A 11/1995 Theurer et al.

FOREIGN PATENT DOCUMENTS

| | | |
|---|---|---|
| DE | 4431503 A1 | 3/1995 |
| EP | 0108168 B1 | 4/1987 |
| FR | 2845701 A1 | 4/2004 |

* cited by examiner

*Primary Examiner* — Robert J McCarry, Jr.
(74) *Attorney, Agent, or Firm* — Laurence A. Greenberg; Werner H. Stemer; Ralph E. Locher

(57) ABSTRACT

A method for renewal of a track includes picking up a plurality of old track panels using a crane jib projecting over the track from a train end of a work train and depositing the old track panels on the work train, thus creating a renewal gap delimited by a gap beginning and a gap end. New ballast is introduced with the aid of the crane jib into the gap end of the renewal gap. Subsequently, a new track panel pre-deposited on the work train is placed by the crane jib on the graded ballast of the gap end. A work train for renewal of a track is also provided.

5 Claims, 1 Drawing Sheet

METHOD FOR RENEWAL OF A TRACK

BACKGROUND OF THE INVENTION

Field of the Invention

The invention relates to a method for renewal of a track, wherein old track panels are removed by an on-track work train and ballast thus exposed is renewed on which, after grading, new track panels are placed. The invention also relates to a work train for renewal of a track.

EP 0 108 168 B1 discloses a work train having a gantry crane for the transport of track panels.

According to U.S. Pat. No. 4,502,389, a work train is also known which has devices for the transport of track panels and ballast.

Brief Summary of the Invention

It is the object of the present invention to provide a method or a work train with which a simplified track renewal is possible.

According to the invention, this object is achieved with a method for renewal of a track, wherein old track panels are removed by an on-track work train and ballast thus exposed is renewed on which, after grading, new track panels are placed. The method comprises the following steps:

a) a plurality of old track panels are picked up by a crane jib, projecting over the track from a train end of the work train, and placed on the work train, thus creating a renewal gap delimited by a gap beginning and a gap end, b) after the renewal gap has reached a desired maximum length, new ballast pre-deposited on the work train is introduced with the aid of the crane jib into the gap end of the renewal gap, c) a new track panel pre-deposited on the work train is placed upon the graded ballast of the gap end by the crane jib (9), and d) the work train is moved in the direction towards the renewal gap on the new track panel, after which the introduction of ballast and the subsequent placement of a new track panel according to steps b) and c) are repeated until the gap beginning is reached.

This object is also achieved by a work train for renewal of a track, including loading areas for storing old and new track panels, and a gantry crane for transporting the track panels which is mobile on crane rails on the work train in a longitudinal direction of the train. The work train comprises the following features:

a) the gantry crane having two crane ends spaced from one another in the longitudinal direction of the train is equipped with a crane jib which has a first end fastened in a pivotable manner to one of the two crane ends and, at a further, second end spaced from the gantry crane in the longitudinal direction of the train, has a gripping device for seizing track panels, and b) at the first crane end of the gantry crane, vertically adjustable supporting devices are disposed for support on the track.

By means of this solution according to the invention, a simplified renewal of a track section can be carried out with relatively little structural expense.

Additional advantages of the invention become apparent from the dependent claims and the drawing description.

BRIEF DESCRIPTION OF THE SEVERAL VIEWS OF THE DRAWING

The invention will be described in more detail below with reference to an embodiment represented in the drawing in which.

DESCRIPTION OF THE INVENTION

Figure 1:
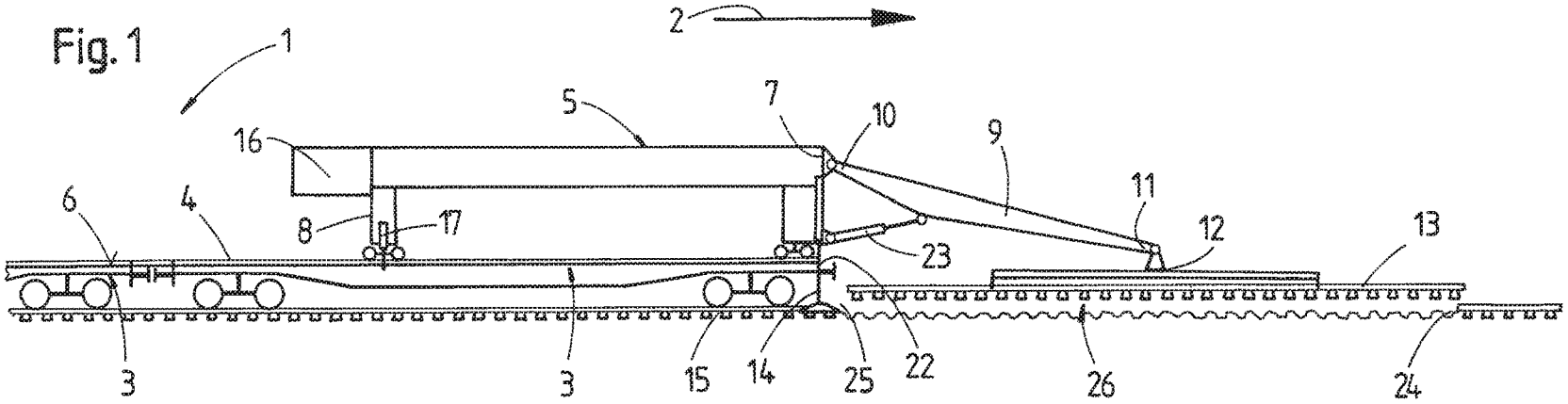
FIGS. 1 and 2 show a side view of the front or rear section, respectively, of a work train for renewal of a track.
Figure 2:
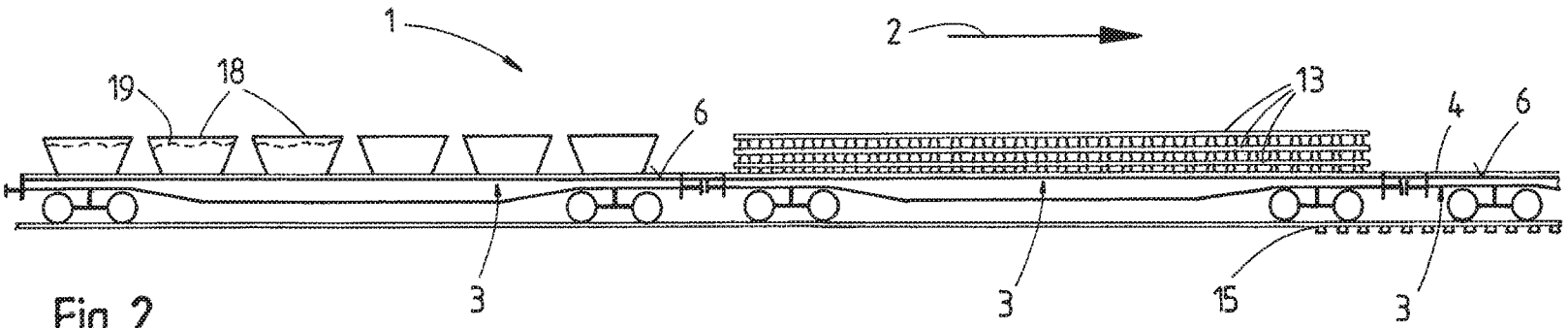

A work train 1, shown in FIGS. 1 and 2, is composed of a number of loading cars 3, arranged one following the other with regard to a longitudinal direction 2 of the train, which are equipped with crane rails 4 for mobility of a gantry crane 5 and with loading areas 6.

The gantry crane 5—having two crane ends 7,8 spaced from one another in the longitudinal direction 2 of the train—is equipped with a crane jib 9. The latter has a first end 10 fastened in a pivotable manner to one of the two crane ends 7,8 and, at a further, second end 11 spaced from the gantry crane 5 in the longitudinal direction 2 of the train, comprises a gripping device 12 for grasping track panels 13.

Arranged at the first end 7 of the gantry crane 5 are vertically adjustable supporting devices 14 for support on a track 15. At the second end 8 of the gantry crane 5, counterweights 16 and gripping devices 17 are provided. The latter are designed to be pivotable perpendicularly to the longitudinal direction 2 of the train for form-locking connection—with regard to avertical—to the crane rails 4.

New ballast 19 is pre-deposited in a number of containers 18 placed on the loading area 6 of a loading car 3. Situated on an adjoining loading car 3 are new track panels 13 stacked one upon the other. The adjacent loading car 3 is provided for depositing old track panels 13.

The method, according to the invention, for renewing the track 15 will now be described in more detail.

At the beginning of operations, the gantry crane 5 is moved to a train end 22, so that the crane jib 9 projects from the work train 1 over the track 15. By means of the crane jib 9 which is vertically adjustable by drives 23 and transversely pivotable, an old track panel 13 is seized by the gripping device 12, picked up and placed on the work train 1, or rather on the loading car 3 provided for that purpose, thus creating a renewal gap 26 delimited by a gap beginning 24 and a gap end 25.

Prior to lifting up the track panel 13, the supporting device 14 is rested on the track 15. Parallel to that, the gripping devices 17 are applied to the crane rails 4 in order to avoid a tilting of the gantry crane 5. This procedure of removing old track panels 13 is continued as desired until the renewal gap 26 has a chosen length. In the meantime, the removal of the old ballast takes place in the trackless renewal gap 26, for example by means of a two-way excavator.

After the renewal gap 26 has reached a desired maximum length, new ballast 19 pre-deposited on the work train 1 is introduced with the aid of the crane jib 9 into the gap end 25 of the renewal gap 26. For that purpose, a container 18 is seized by the gripping device 12 of the crane jib 9 and opened above the renewal gap 26 for evacuation. The discharged ballast 19 is graded by the already mentioned excavator.

As soon as the new ballast 19 has been graded for the length of a track panel, a new track panel 13 pre-deposited on the work train 1 is laid down upon the ballast 19 of the gap end 25 by means of the crane jib 9.

Subsequently, the work train 1 is moved on the new track panel 13 in the direction towards the renewal gap 26, after which the introduction of ballast and the subsequent placement of a new track panel 13 is repeated in the just described manner until the track 15 has been completely renewed in the area of the renewal gap 26.

Adjacent to the now eliminated renewal gap 26, the described method steps are repeated in that, by removal of old track panels, another new track gap 26 is created which is again closed step-by-step by new track panels for renewing the track 15.

The invention claimed is:

1. A method for renewal of a track, the method comprising the following steps:

a) pivotably mounting a crane jib on a gantry crane having a first end supported on a track by vertically adjustable supporting devices, picking up a plurality of old track panels by using the crane jib projecting over the track from a train end of an on-track work train, and placing the old track panels on the work train, to create a renewal gap delimited by a gap beginning and a gap end and to expose ballast;

b) after the renewal gap has reached a desired maximum length, using the crane jib to introduce new ballast pre-deposited on the work train into the gap end of the renewal gap and grading the ballast;

c) placing a new track panel pre-deposited on the work train upon the graded ballast at the gap end by using the crane jib; and d) moving the work train on the new track panel in a direction towards the renewal gap, and then repeating the introduction of ballast and the subsequent placement of a new track panel according to steps b) and c) until reaching the gap beginning.

2. The method according to claim 1, which further comprises carrying out the step of introducing the new ballast using the crane jib by using containers to be emptied above the renewal gap.

3. A work train for renewal of a track, the work train comprising:

loading areas on the work train for storing old and new track panels;

crane rails disposed on the work train;

a gantry crane being movable on said crane rails in a longitudinal direction of the work train for transporting the track panels, said gantry crane having first and second crane ends being spaced from one another in the longitudinal direction of the work train;

a crane jib having a first end pivotably fastened to said first crane end and a second end spaced from said gantry crane in the longitudinal direction of the work train;

a panel gripping device disposed at said second end of said crane jib for seizing track panels and for introducing new ballast pre-deposited on the work train onto the track; and vertically adjustable supporting devices disposed at said first crane end for supporting said gantry crane on the track.

4. The work train according to claim 3, which further comprises counterweights disposed at said second crane end of said gantry crane.

5. The work train according to claim 3, which further comprises rail gripping devices disposed at said second crane end of said gantry crane and being pivotable perpendicularly to the longitudinal direction of the work train, said rail gripping devices form-locking connecting said gantry crane to said crane rails in a vertical direction.

* * * * *